US009605920B2

(12) United States Patent
Velez

(10) Patent No.: US 9,605,920 B2
(45) Date of Patent: Mar. 28, 2017

(54) HAMMER STRUT SUPPORT

(71) Applicant: Thomas Andrew Velez, Santa Rosa Beach, FL (US)

(72) Inventor: Thomas Andrew Velez, Santa Rosa Beach, FL (US)

( * ) Notice: Subject to any disclaimer, the term of this patent is extended or adjusted under 35 U.S.C. 154(b) by 21 days.

(21) Appl. No.: 14/827,912

(22) Filed: Aug. 17, 2015

(65) Prior Publication Data

US 2017/0051994 A1 Feb. 23, 2017

(51) Int. Cl.
*F41A 19/14* (2006.01)

(52) U.S. Cl.
CPC ..... *F41A 19/14* (2013.01)

(58) Field of Classification Search
CPC ..... F41A 19/14
USPC ... 42/69.03, 108, 7, 48, 6, 69.01, 90; 89/147
See application file for complete search history.

(56) References Cited

U.S. PATENT DOCUMENTS 2,655,839 A 10/1953 Ruger
3,756,120 A * 9/1973 Roy ..... F41A 5/04 89/163
5,666,755 A 9/1997 Longueira

* cited by examiner

*Primary Examiner* — Reginald Tillman, Jr.

(57) ABSTRACT

A hammer strut support (150, 156, 160, 162, 166) in a firearm which supports or aligns a free end (134) of a pivotally mounted hammer strut (116), and physically blocks it from becoming lodged in a position, typically under a crosspin (120) such as a sear spring stop pin, that would preclude subsequent proper reassembly of firearm, unless un-lodged and properly repositioned. It is sandwiched in, and may also envelop, firearm structure. Upper surface (154) of hammer strut support may also have a guide channel (164) to align hammer strut (116).

5 Claims, 8 Drawing Sheets

Firearm Without Hammer Spring Assembly.
Bolt Removed. Hammer Strut in Correct Position.

Firearm Without Hammer Spring Assembly.
Bolt Removed. Hammer Strut in Wrong Position-
Free End Trapped Behind Crosspin.

Hammer Strut Support-Option 1
One Hole Option
Firearm Without Hammer Spring Assembly.
Bolt Removed.

Hammer Strut Support-Option 2
One Slot Option
Firearm Without Hammer Spring Assembly.
Bolt Removed.

Hammer Strut Support-Option 3
Bendable Support Option
Firearm Without Hammer Spring Assembly.
Bolt Removed.

Hammer Strut Support-Option 4
Guide Channel Option Showing V-shaped Upper Surface.
Firearm Without Hammer Spring Assembly.
Bolt Removed.

Hammer Strut Support-Option 5
Bendable Flap Option to Enclose Hole.
Firearm Without Hammer Spring Assembly.
Bolt Removed.

HAMMER STRUT SUPPORT

CROSS-REFERENCE TO RELATED APPLICATIONS

This application claims the benefit of the following Provisional Patent Applications, filed by the present inventor, which is incorporated by reference:

EFS ID: 21432519
Application No. 62/113,455
Filed: 8 Feb. 2015
EFS ID: 21364564
Application No. 62/110,295
Filed: 30 Jan. 2015

BACKGROUND AND DISCUSSION OF PRIOR ART

1. Background

See FIG. 1. Many firearms 100 have a pivotally mounted hammer strut 116. This is mounted to a pivotally mounted hammer 112 which is actually used to strike a cartridge or an interposed firing pin which then actually strikes the cartridge, thereby actually firing firearm 100. A hammer strut free end 134 is normally actuated or pushed by a hammer spring 124. In many firearms 100, reassembly of firearm 100 is made difficult by the necessity to properly align this hammer strut free end 134 during reassembly of firearm 100.

This reassembly difficulty is especially true in semi-automatic pistols and rifles of the "blowback" design of firearms 100. In these firearms 100, a bolt is "blown" back as a result of the cartridge firing and the expanding gasses pushing the bolt rearward. This is in contrast to other designs wherein the cartridge firing causes a receiver, barrel, or a slide to move rearward. One example of this blowback" design of firearms 100 is multiple iterations of Ruger Mk series of pistols.

FIG. 2 shows the proper alignment of hammer strut free end 134 in its proper position above a crosspin 120. In the Ruger Mk 1, MkII, and MkIII series of firearms 100, this crosspin 120 is a sear spring stop pin. This is the proper alignment of hammer strut free end 134 necessary for proper reassembly of firearm 100, specifically for its proper connection to hammer spring 124, hammer spring assembly 122, or a mating adapter such as a plunger 128, or a cap, adapter, or detent instead of a plunger. A plunger is used in the Ruger Mk series pistols.

Since hammer 112 can rotate upwards about hammer pivot pin 114, it can be seen that upward rotation of hammer 112 can allow hammer strut free end 134 to be raised above crosspin 120 and because of gravity, to fall and rotate into a position underneath crosspin 120, and become trapped in that position, especially if hammer is subsequently rotated back downward.

FIG. 3 clearly shows this entrapment of hammer strut free end 134. If hammer strut free end 134 is below crosspin 120, it will not enter hammer spring plunger 128 or hammer spring assembly 122 and will not be available to power hammer 112 via hammer strut 116.

This prohibits proper reassembly of firearm 100 until this condition is corrected. The proper position of hammer strut free end 134, above crosspin 120 is necessary for proper connection to hammer spring 124, hammer spring assembly 122, or a mating adapter 128 such as the hammer spring plunger 128, or a cap, adapter, or detent used instead of the hammer spring plunger 128.

However, the design of firearm 100 allows reassembly with this entrapment. During reassembly of firearm 100, physical viewing of hammer strut 116 is obscured by hammer spring assembly 122. If reassembly of firearm 100 is completed with hammer strut 116 lodged under crosspin 120, it renders firearm 100 inoperable. It is also then impossible to disassemble firearm 100 to correct this condition until hammer strut 116 is correctly positioned. However, once firearm 100 is assembled, physical and visual access to hammer strut 116 is denied by the physical structure of the weapon.

An entire sequence of manipulations of firearm 100 controls and multiple orientations of firearm 100 are required to enable proper alignment of hammer strut free end 134. All this must be done without visual or physical clues of the actual alignment of hammer strut free end 134. Until corrected, firearm 100 is inoperable.

This generates significant personal frustration and effort. This hammer strut positioning and reassembly problem is well known. Suggested operational techniques on how to regain proper positioning of hammer strut free end 134 are well documented in writing, in many videos, and on the Internet.

However, no one has published a hardware solution to preclude this entrapment of free end of hammer strut 134. All solutions are operational precautions or methodologies attempting either to prevent the event, or to recover after the event has occurred.

2. Discussion of Prior Art

The following is a tabulation of some prior art that presently appears relevant:

| Pat. No. | Kind Code | Issue Date | Patentee |
|---|---|---|---|
| U.S. Pat. No. 2,655,839 | A | Oct. 20, 1953 | Ruger, William B |
| U.S. Pat. No. 5,666,755 | A | Sep. 16, 1997 | Dino C Longueira |

Patent number U.S. Pat. No. 2,655,839 A, "Blowback Autoloading Pistol", by William Ruger is for an entire Autoloading Pistol, which led to the Ruger Mk I series of semi-automatic pistols. That patent is for the design of the entire pistol, especially the bolt and it features, the manufacturing methodology of the pistol, and retention of a frame, receiver, and bolt. That specific design does have the disassembly and reassembly problem stated above, pertaining to the required alignment of the free end of hammer strut 134.

Patent number U.S. Pat. No. 5,666,755 A, "Method and apparatus for fast disassembly of blowback autoloading pistol", by Dino C Longueira, does not attempt to address the reassembly problem if hammer spring 124 or hammer spring assembly 122 is removed, but rather to simplify bolt removal of such a firearm 100 described above. That patent is for a new hammer spring assembly 122 incorporating a new two-piece bolt stop pin 132, and also for a requisite new hammer 112 needed to function with it. Since hammer spring assembly 122 also secures frame 108 to receiver 104, firearm frame 108 and receiver 104 still cannot be separated for cleaning or maintenance without removal of hammer spring assembly 122, which that patent does not address at all. That patent does not remedy hammer strut free end 134 alignment or reassembly problem at all.

Therefore, there is no known published hardware solution to position hammer strut free end 134 properly for reassembly of such firearms 100, if hammer spring 124 or hammer spring assembly 122 has been removed.

SUMMARY OF THE EMBODIMENTS

A hammer strut support, demonstrated in various embodiments 150, 156, 160, 162, 166, is presented that supports or aligns hammer strut free end 134 of a pivoting hammer strut 116 in a firearm 100, to assist positioning pivoting hammer strut 116 for reassembly of firearm 100. The hammer strut support, demonstrated in various embodiments 150, 156, 160, 162, 166, may facilitate insertion of hammer strut free end 134 into one end of a hammer spring 124, or a topping device such as a hammer spring plunger 128, cap, adapter, or detent for hammer spring 124. Hammer strut support, demonstrated in various embodiments 150, 156, 160, 162, 166, may incorporate at least one guide channel 164 for pivoting hammer strut free end 134. Hammer strut support, demonstrated in various embodiments 150, 156, 160, 162, 166, may be retained at least partially by nearby structure of firearm 100, such as crosspin 120, a structure housing hammer spring or hammer spring assembly 126, or a magazine well aft wall 111.

DRAWING FIGURES INCLUDED

Included are 8 drawings.

FIG. 1 prior art, is a view of a semi-automatic firearm of the blowback design, with the hammer strut in its proper position.

DETAILED DESCRIPTION OF SPECIFIC EMBODIMENTS AND ADVANTAGES OVER PRIOR ART

Advantages Over Prior Art

Figure 1:
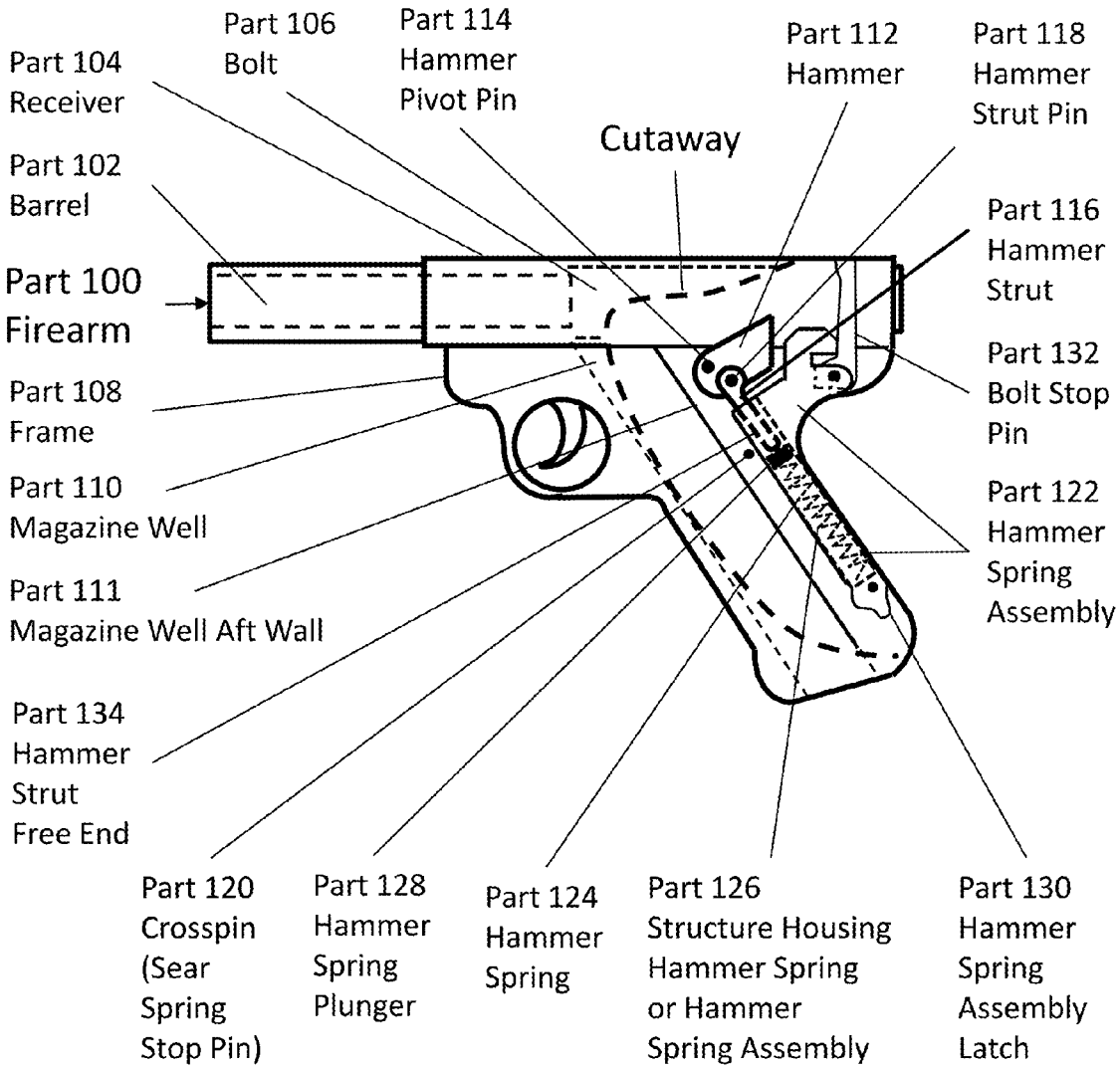
FIG. 1 Prior Art
Figure 2:
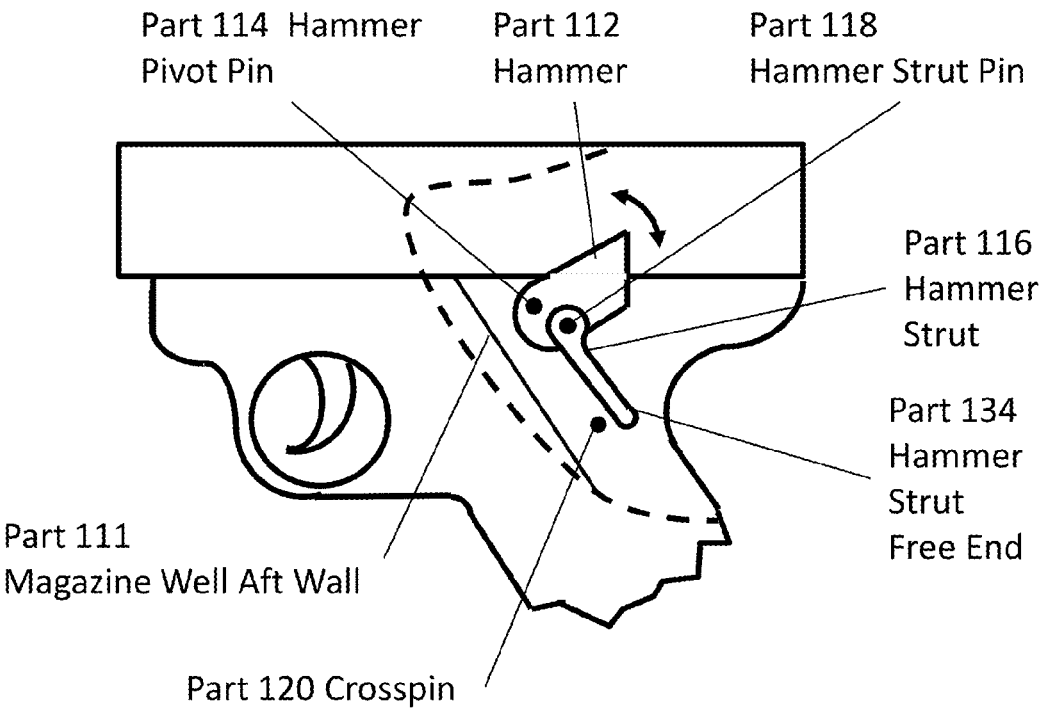
FIG. 2 is a closer view of the firearm's hammer area, with the bolt and hammer spring assembly removed, and with hammer strut in proper position.
Figure 3:
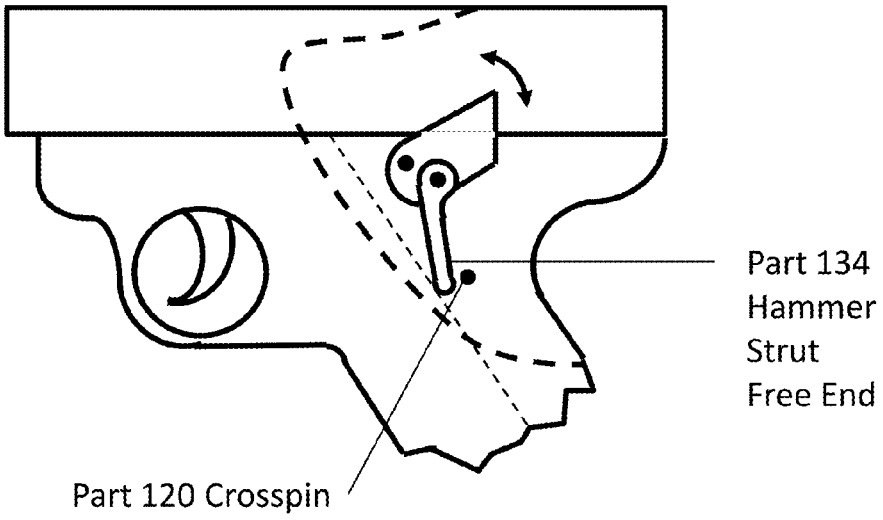
FIG. 3 is a closer view of the firearm's hammer area, with the bolt and hammer spring assembly removed, and with the hammer strut in the wrong position, trapped behind the crosspin.

This new hammer strut support 150, 156, 160, 162, 166, is a simple non-moving item which, when installed, simplifies the reassembly of many semi-automatic firearms 100 of the blowback design. Such firearms 100 of that design include that patented by William B. Ruger (U.S. Pat. No. 2,655,839, Nov. 5, 1946) and exhibited in the manufacture of Ruger Mk I, Mk II, and Mk III series pistols, as well as some Browning pistols, and some pistols and rifles of similar construction by other manufacturers.

This new hammer strut support 150, 156, 160, 162, 166, allows and maintains the proper position of hammer strut 116 for firearm 100 reassembly, when hammer spring 124 or hammer spring assembly 122 has been removed from firearm 100. More specifically, this hammer strut support 150, 156, 160, 162, 166, prevents free end of hammer strut 134 from moving into a position underneath a crosspin 120 (sear spring stop pin) and becoming trapped in that position, which would prohibit proper reassembly of firearm 100. If firearm 100 is assembled with hammer strut free end 134 under crosspin 120, assembly is still possible but firearm 100 would be inoperable and very difficult to subsequently disassemble to correct the problem.

When installed, this new hammer strut support 150, 156, 160, 162, 166, permanently prohibits this hammer strut free end 134 "entrapment" condition from occurring. There is no prior art that accomplishes this: preventing free end of hammer strut 134 from becoming lodged under crosspin 120, while hammer spring 124 or hammer spring assembly 122 is not installed in firearm 100.

Evidently, this hammer strut support 150, 156, 160, 162, 166, concept has not been obvious to practitioners of the firearms industry. Even though these types of firearms 100 have been manufactured for over 60 years, there has never been a published hardware based solution to correct this hammer strut free end 134 "entrapment" problem.

DETAILED DESCRIPTION OF SPECIFIC EMBODIMENTS

Figure 4:
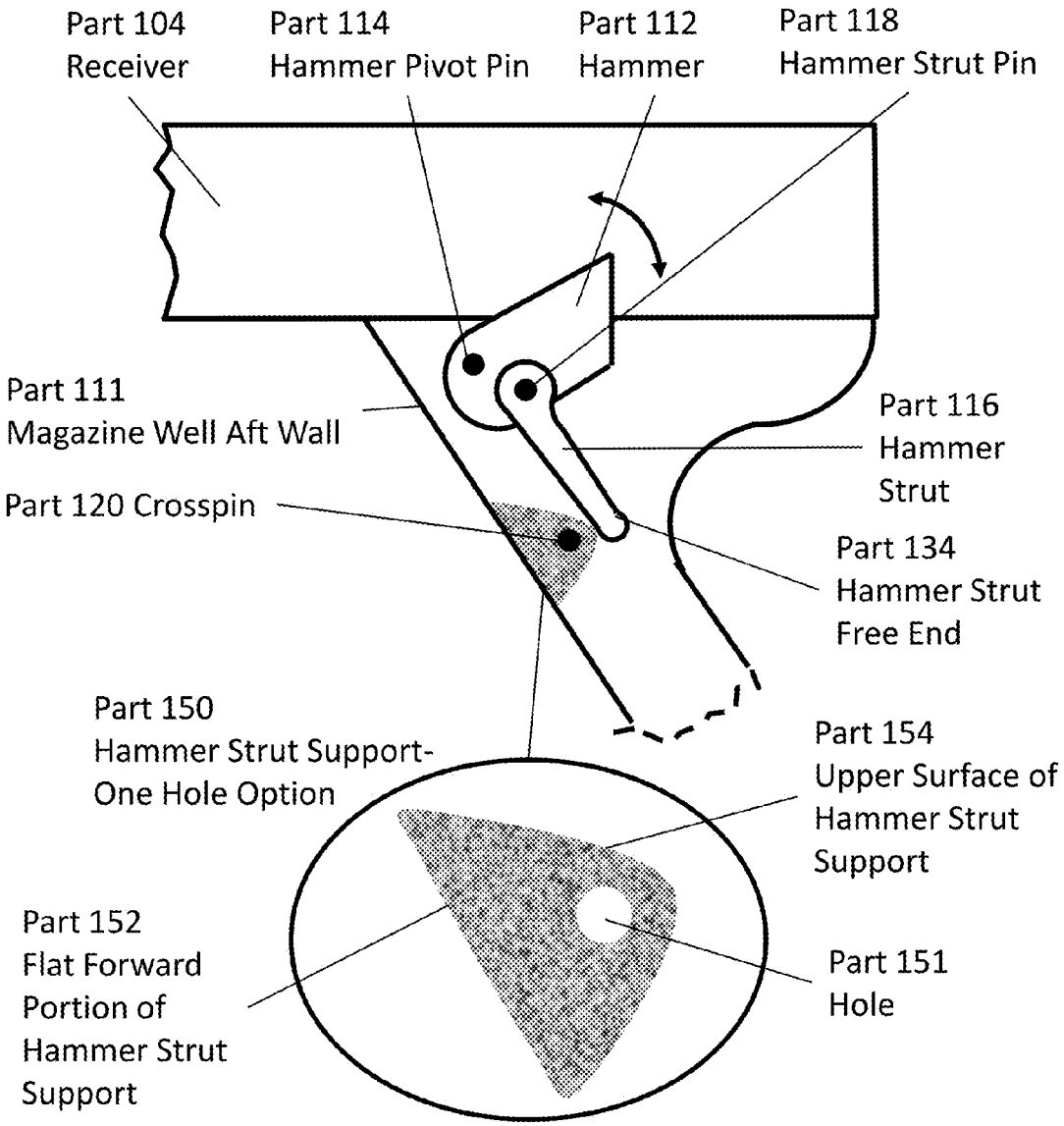
FIG. 4 shows a hammer strut support embodiment, with a one hole option.

FIG. 4 shows an embodiment of a hammer strut support with a one hole option 150 mounted on crosspin 120, which is threaded through a hole 151 in hammer strut support 150. Flat portion of hammer strut support 152 is against magazine well aft wall 111. Hammer strut support 150 is thus securely held in position by crosspin 120 and magazine well aft wall 111.

Upper surface of hammer strut support 154 provides support for hammer strut free end 134, preventing it from becoming lodged under crosspin 120. Even if hammer 112 is rotated upwards about hammer pivot pin 114, hammer strut free end 134 cannot slip behind or underneath crosspin 120, because it is forced to travel above upper surface of hammer strut support 154.

Figure 5:
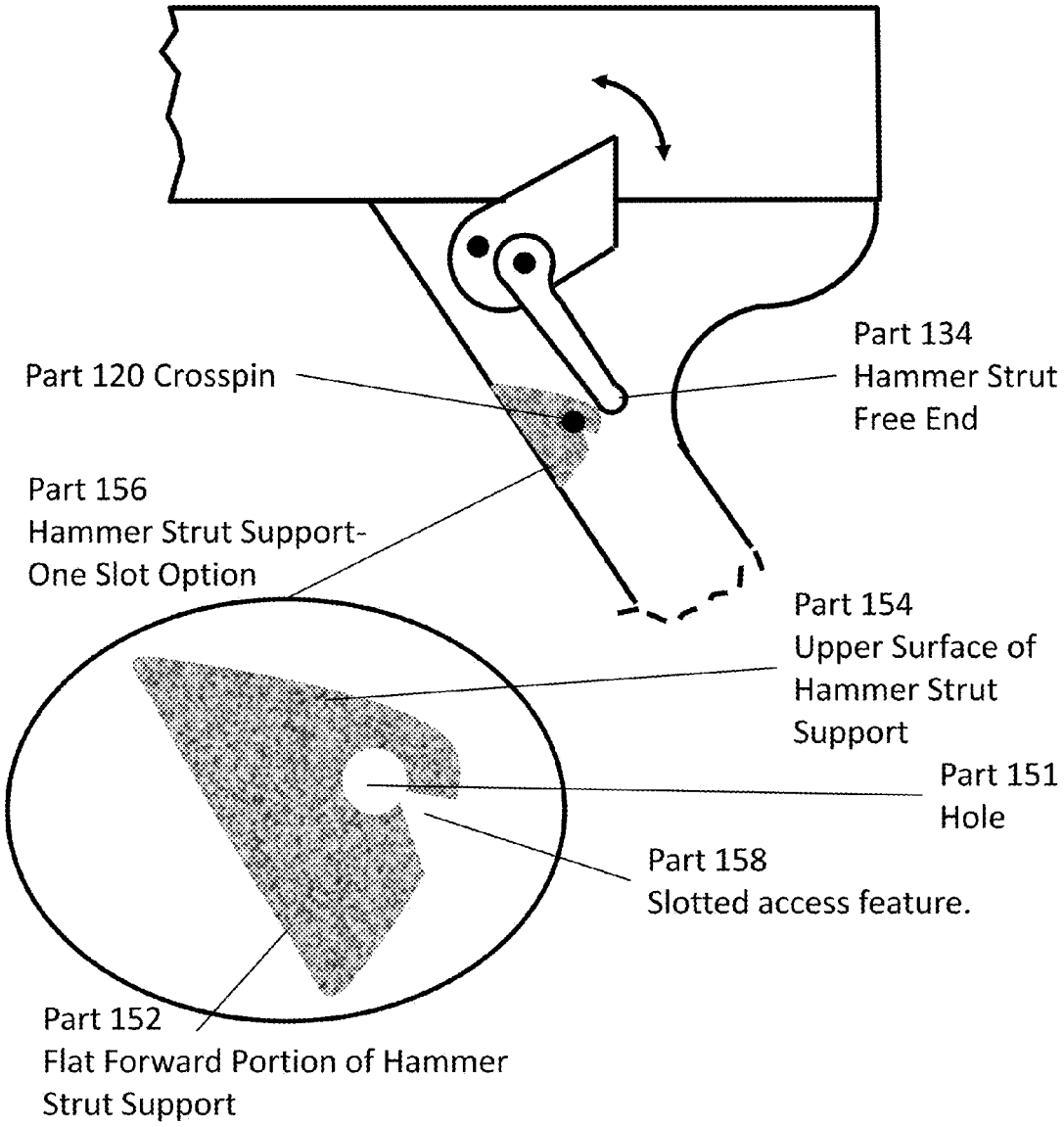
FIG. 5 shows a hammer strut support embodiment, with a one slot option.

FIG. 5 shows an embodiment of a hammer strut support with a one slot option 156. In this configuration, hammer strut support one slot option 156 is simply manually forced upon crosspin 120 using slotted access feature 158 to position hole 151 upon crosspin 120 with flat forward portion of hammer strut support 12 against magazine well aft wall 111. In this embodiment, the resiliency of a semi-flexible material provides partial closure after insertion and retains crosspin 120 in hole 151 of hammer strut support one slot option 156. Hammer strut support one slot option 156 provides support for hammer strut free end 134, preventing it from becoming lodged under crosspin 120 because it is forced to travel above upper surface of hammer strut support 154.

Figure 6:
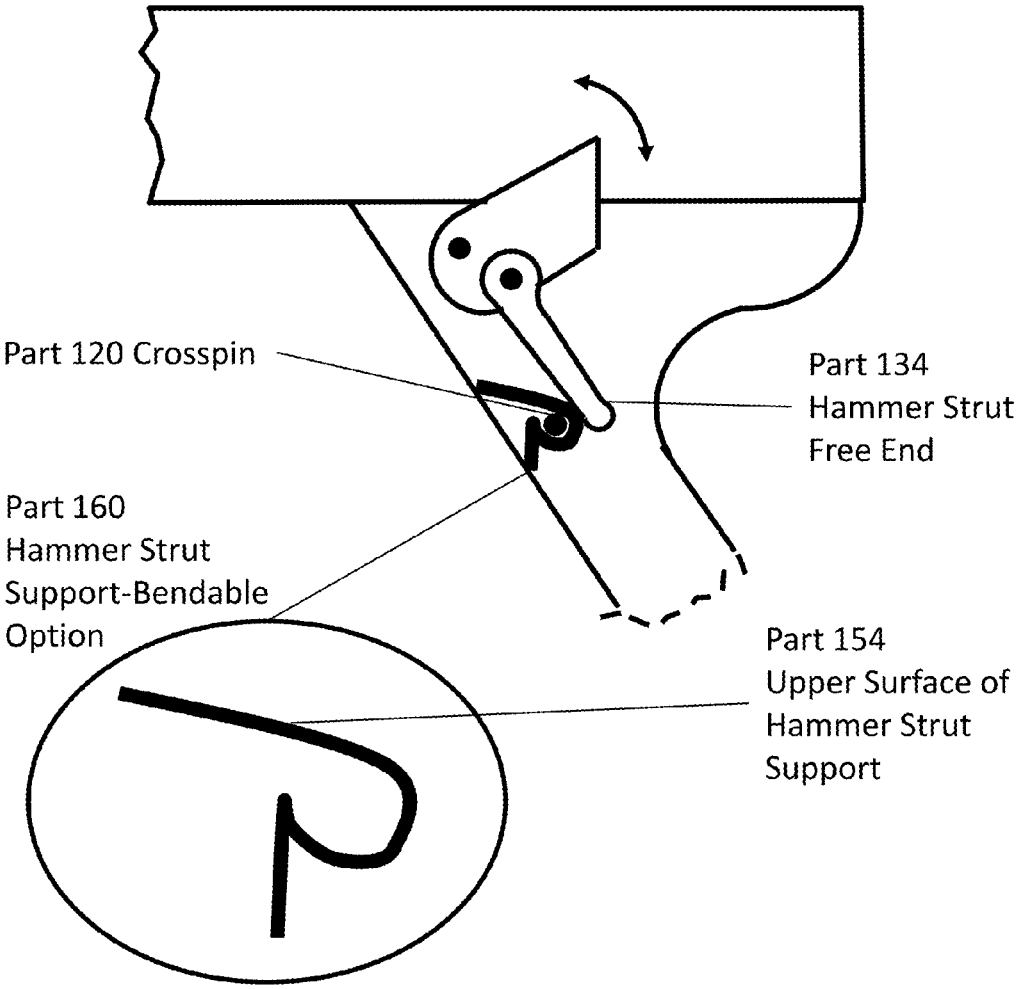
FIG. 6 shows a hammer strut support embodiment, with a bendable option.

FIG. 6 shows an embodiment of a hammer strut support with a bendable option 160 constructed of a bendable, nominally rectangular cross-section material, such as aluminum or thin steel or other suitable material. In this embodiment, hammer strut support with bendable option 160 is manually placed into position over crosspin 120, and compressed upon crosspin 120 using simple tool, such as a needle nose pliers. Once compressed upon crosspin 120, both ends of hammer strut support bendable option 160 are positioned firmly against magazine well aft wall 111 as shown, thereby being rigidly held in place. As in previous embodiments, hammer strut support bendable option 160 provides support for hammer strut free end 134, preventing it from becoming lodged under crosspin 120 because it is forced to travel above upper surface of hammer strut support 154.

Figure 7:
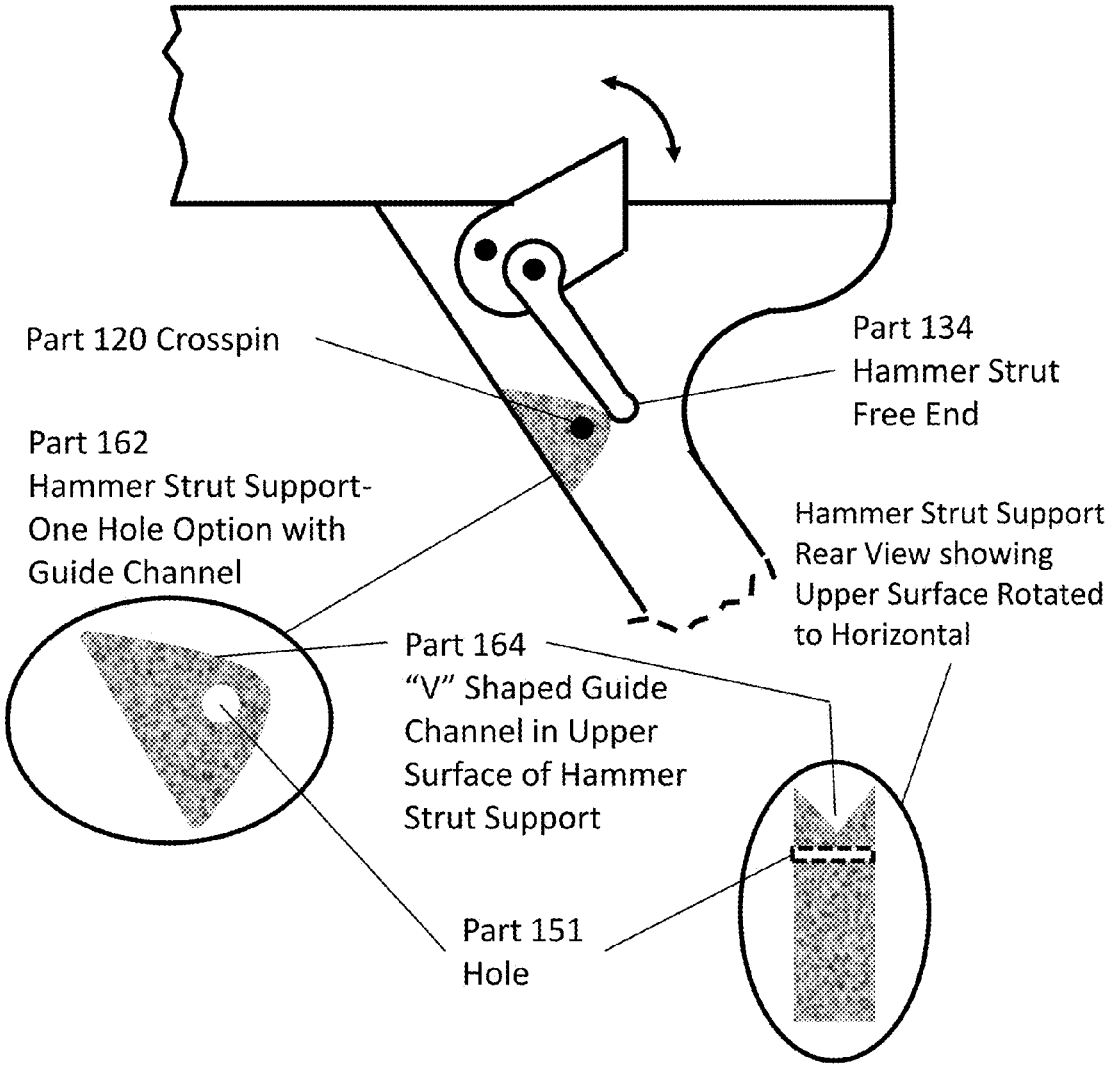
FIG. 7 shows a hammer strut support embodiment with a guide channel option.

FIG. 7 shows an embodiment of a hammer strut support one hole option with guide channel 162 constructed with a guide channel upper surface 164, represented by a "v" shaped guide channel as shown. When firearm 100 is held horizontal, gravity will aid in keeping hammer strut free end 134 centered and above crosspin 120, and in perfect position to engage hammer spring plunger 128 or its equivalent cap, adapter, or detent for hammer spring 124.

Figure 8:
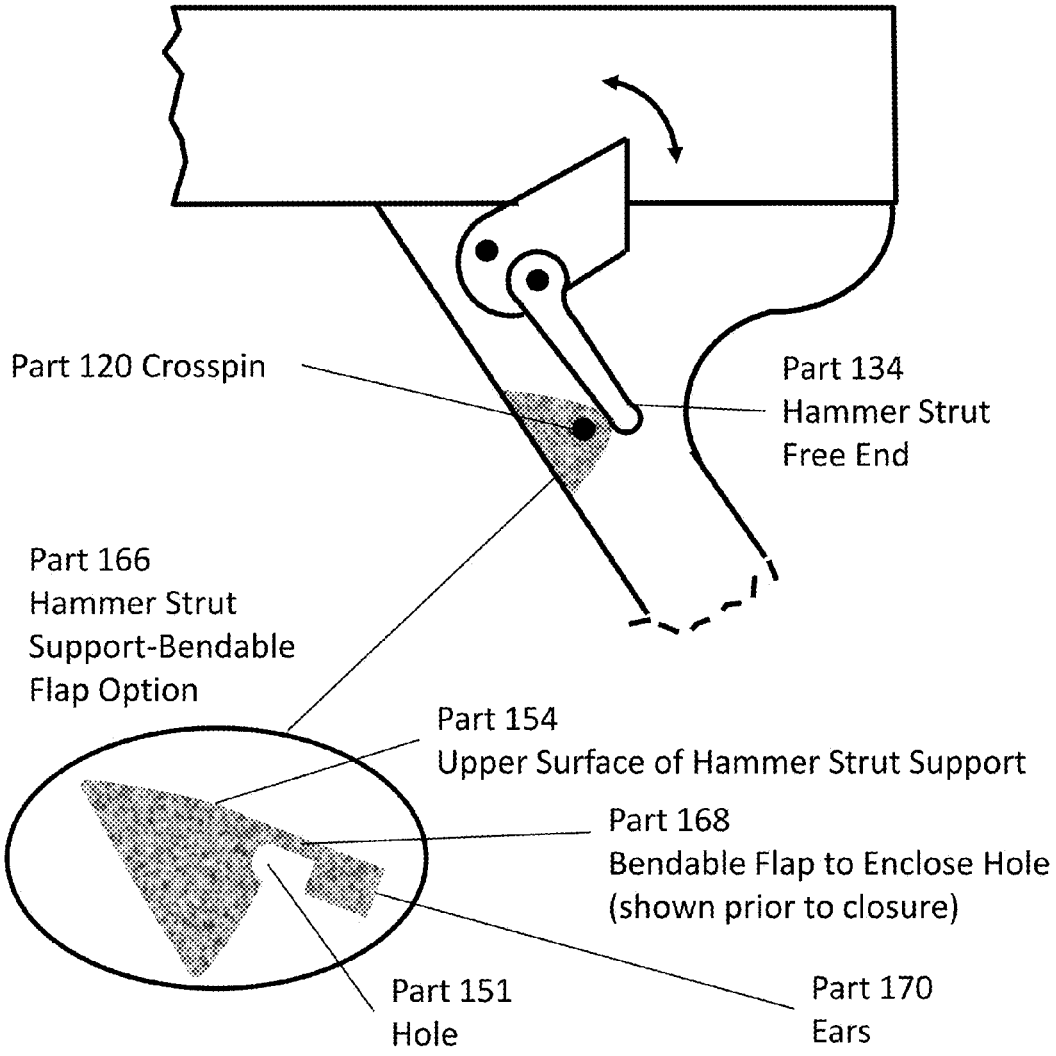
FIG. 8 shows a hammer strut support embodiment, with bendable flap option.

FIG. 8 shows an embodiment of a hammer strut support bendable flap option 166 constructed with a bendable flap 168 which is folded over hole 151, to enclose it, and may be constructed with ears 170 on each side to grasp and hold flap to the main body of hammer strut support bendable flap option 166. Other common methods other than ears 170 may be used to maintain closure of the hole, such as glue, slot and insert, press pin, etc. Alternatively, flap 168 may be constructed to fold up and over crosspin 120 to enclose hole 151, rather than down and around crosspin 120.

Operation

In all the embodiments, hammer strut free end 134 is prevented from ever becoming positioned beneath crosspin 120, while hammer spring 124 or hammer spring assembly 122 is not installed in firearm 100. This therefore precludes any possibly of hammer strut free end 134 becoming entrapped below crosspin 120.

This is accomplished by the lower portion potential movement path of hammer strut free end 134 being physically obstructed by upper surface of hammer strut support 154. Additionally, guide channel on upper surface of hammer strut support 164 (FIG. 7), which if incorporated on any embodiment, would provide proper lateral alignment of hammer strut free end 134 into one end of a hammer spring 124, or a topping device such as a hammer spring plunger 128, cap, adapter, or detent for hammer spring 124.

While it is limited by the mechanical clearances of the rotatably mounted hammer strut 116 about hammer strut pin 118, there is some lateral movement of hammer strut free end 134. This limited amount of lateral movement is not significant enough to prevent proper reassembly of firearm 100. Guide channel on upper surface of hammer strut support 164 (FIG. 7) negates that lateral movement hammer strut free end 134 also.

Dimensions, Materials, and Construction

The figures shown are two dimensional. Since there are a myriad of different firearms and internal dimensions, actual dimensions of hammer strut support 150, 156, 160, 162, 166, will be based upon and tailored for the actual dimensions of the firearm that it will be installed into.

There is nothing else special about the third dimension (depth or thickness) which is not shown in the FIGS. The various embodiments of hammer strut support 150, 156, 160, 162, 166 do not need any variation in the third dimension, but may be of a uniform cross-section, or be modified as desired, such a making it thin-walled to aid in construction processes or to reduce weight or cost or to increase flexibility or bendability. The only restriction is that hammer strut support 150, 156, 160, 162, 166 not be larger than can be installed into the particular firearm that the item is being designed to fit into.

Construction materials may be of a plastic or polymer, metallic such as aluminum, steel, or other alloys, even something as simple as wood or other easily manufactured and processed materials, depending on which embodiment of hammer strut support 150, 156, 160, 162, or 166 is being manufactured.

FIG. 4 hammer strut support one hole option embodiment 150 may be made of a material rigid enough to retain its shape, or at least return to its desired shape after installation.

FIG. 5 hammer strut support one slot option embodiment 156 may be made of a material flexible enough to be pressed over crosspin 120 and then return to its original shape, and thereafter retain its original shape, unless intentionally removed.

FIG. 6 hammer strut support bendable option embodiment 160, may be made of a material flexible enough to be pressed over crosspin 120 and then retain that newly pressed shape, unless intentionally removed, rather that returning to its original shape. Metallic materials may be used in this embodiment, but some polymers might also be used.

FIG. 7 hammer strut support one hole option with guide channel embodiment 162, may be made of a material rigid enough to retain its shape, or at least return to its desired shape after installation.

FIG. 8 hammer strut support bendable flap option embodiment 166 may be made of a material having the flexibility in the material to actually fold bendable flap 168 around crosspin 120 and for ears 170 to stretch and snap over the main body of hammer strut support 166, and perhaps engage in slots or ridges, but have the rigidity to retain the clamping action of ears 170, if used.

Construction methods of hammer strut support 150, 156, 160, 162, or 166 may be any of a variety of well known current technology methods. These include but are not limited to: injection molding of polymer materials, stamping, pouring, milling, grinding, bending, forming, drilling, cutting, extruding, etc.

CONCLUSION, RAMIFICATIONS, AND SCOPE

It is to be understood, that portions of each of the various embodiments demonstrated in FIG. 4-8, can be mixed or combined with portions of the other embodiments. While my above description contains many specificities, these should not be construed as limitations on the scope, but rather as an exemplification of several possible embodiments thereof. These embodiments were shown to illustrate and explain design concepts, functions, purpose, operation, installation and construction of the various embodiments, but are not all inclusive of all the permutations possible.

Other implementations, variations, and improvements are possible, such as:

- Making hammer strut support 150, 156, 160, 162, 166 lighter or using less material, by changing the non-essentials of the design using well known techniques (but retaining upper surfaces 154 and 164 as desired of hammer strut support options 150, 156, 160, 162, 166 such as
  - Additional holes
  - Thinner cross section in some areas
  - Web/skeleton cross section in some areas
- Different methods of enclosing hole 151
- Different shapes of upper surface of hammer strut support 154 and 164, other than being essentially flat, or a "V" shape, such as being a "U" shape
- Packing the area about crosspin 120 with some material to emulate upper surface 154 or 164 of hammer strut support, to preclude free end 134 of hammer strut 116 from moving beneath or below crosspin 120.

Thus several embodiments have been shown to preclude hammer strut free end 134 of hammer strut 116 from moving beneath or below crosspin 120. Accordingly, the scope should be determined not by the embodiments illustrated, but by the appended claims and their legal equivalents.

LIST OF PART NUMBERS

Part 100 Firearm
Part 102 Barrel
Part 104 Receiver
Part 106 Bolt
Part 108 Frame
Part 110 Magazine Well
Part 111 Magazine Well Aft Wall
Part 112 Hammer
Part 114 Hammer Pivot Pin
Part 116 Hammer Strut
Part 118 Hammer Strut Pin
Part 120 Crosspin (Sear Spring Stop Pin)
Part 122 Hammer Spring Assembly
Part 124 Hammer Spring
Part 126 Structure Housing Hammer Spring or Hammer Spring Assembly
Part 128 Hammer Spring Plunger
Part 130 Hammer Spring Assembly Latch
Part 132 Bolt Stop Pin
Part 134 Hammer Strut Free End
Part 150 Hammer Strut Support-One Hole Option
Part 151 Hole
Part 152 Flat Forward Portion of Hammer Strut Support
Part 154 Upper Surface of Hammer Strut Support
Part 156 Hammer Strut Support-One Slot Option
Part 158 Slotted Access Feature
Part 160 Hammer Strut Support-Bendable Option
Part 162 Hammer Strut Support-One Slot Option With Guide Channel
Part 164" V" Shaped Guide Channel in Upper Surface of Hammer Strut Support
Part 166 Hammer Strut Support-Bendable Flap Option
Part 168 Bendable Flap to Enclose Hole
Part 170 Ears

I claim:

1. A hammer strut support for preventing a hammer strut of a firearm from rotating to a position underneath a crosspin, the hammer strut support comprising:

a body having a first side for resting against the magazine well aft wall; a second side to support the free end of the hammer strut at least during removal and assembly of the hammer mainspring; and a hole between the first and second sides, the hole being sized and configured to receive a crosspin therein.

2. A method of forming a hammer strut support, the hammer strut support being configured to prevent the hammer strut of a firearm from rotating to a position underneath a crosspin, the method comprising:

obtaining a bendable material having opposed ends, the bendable material having a rectangular cross-section, bending the material around a crosspin of a firearm to create an upper surface that supports the free end of the hammer strut, wherein the opposed ends of the material rest against the magazine well aft wall.

3. The hammer strut support of claim 2, wherein a surface of the second side of the body has a groove along a portion thereof to receive the hammer strut.

4. The hammer strut support of claim 2, wherein the body further comprising a bendable flap extending away from the hole, and configured for folding over the hole to enclose the hole and the crosspin therein.

5. The hammer strut support of claim 2, wherein the body further comprising a slot extending from the hole to the outside perimeter of the body.

* * * * *